United States Patent [19]

Schwarzhoff

[11] Patent Number: 4,518,215

[45] Date of Patent: May 21, 1985

[54] MULTI-POLE ELECTRIC PLUG

[75] Inventor: Wolfgang Schwarzhoff, Lüdenscheid, Fed. Rep. of Germany

[73] Assignee: Robert Bosch GmbH, Stuttgart, Fed. Rep. of Germany

[21] Appl. No.: 530,804

[22] Filed: Sep. 9, 1983

[30] Foreign Application Priority Data

Nov. 26, 1982 [DE] Fed. Rep. of Germany ..... 3243729

[51] Int. Cl.[3] ..... H01R 13/506; H01R 13/621

[52] U.S. Cl. ..... 339/92 R; 339/196 R

[58] Field of Search ..... 339/63 R, 63 M, 92 R, 339/92 M, 196 R, 196 A, 196 M, 206 R, 206 P

[56] References Cited

FOREIGN PATENT DOCUMENTS 1140068 2/1957 France ..... 339/196 R 440480 10/1948 Italy ..... 339/196 R

*Primary Examiner*—Neil Abrams

*Attorney, Agent, or Firm*—Edwin E. Greigg

[57] ABSTRACT

A multi-pole electric plug having two housing parts nested in one another is proposed, in which both housing parts are connected in the direction in which they are put together by means of a snap connector which locks into place automatically when the parts are put together. The snap connector has a protruding finger with a thickened snap head in the outer housing part and in the inner housing part has a passageway bore intended for the finger and having a protruding inner annular shoulder, which is engaged from the back by the snap head. Unintentional unlocking is prevented by a threaded segment of a screw extending through the finger, which when the plug is inserted is simultaneously screwed in as a screw securing means.

8 Claims, 6 Drawing Figures

MULTI-POLE ELECTRIC PLUG

BACKGROUND OF THE INVENTION

The invention is based on a multi-pole electric plug as generally defined hereinafter. Plugs of this kind are conventionally connected to one another and held together by means of screws used as fastening elements. To this end, one housing part carries the screw, while the other housing part has a corresponding nut or threaded sleeve attached such that it cannot be lost. Such fastening elements represent a not insubstantial labor cost for assembly, both when such plugs are first put together and when the plugs are or the cable is changed. The materials cost for these parts of the fastening elements are also quite high in view of the quantity produced. A further disadvantage is that the screw and/or the nut can still fall out and be lost, especially during assembly or disassembly. This possibility increases the cost of production and materials. Should such a loss occur later, once a user has the plug, then if there is no replacement part the plug is not usable any longer.

OBJECT AND SUMMARY OF THE INVENTION

The multi-pole electric plug according to the invention has the advantage over the prior art in that both housing parts can be put together quickly and easily, and they can be firmly connected with one another in a durable manner by the snap connection of the snap connector thus attained. The elements of the snap connector can be molded on at the same time as the plugs are produced, as is preferred, by plastic injection molding. In other words, these elements are integral components of the two housing parts and cannot be lost. Also, because they are molded simultaneously with the production of the plugs, the expense for such fastening elements is reduced, which is an important consideration in the case where high quantities are being produced. At the same time, because of the snap connector there is a predetermined, replicable tensioning force existing between the two put-together housing parts. Such harmful situations as where one or the other housing part is damaged because a screw is tightened excessively are thereby precluded.

The advantages of the invention allow for a particularly simple and inexpensive embodiment of the two elements of the snap connector, namely the finger with the snap head on one side and the recess on the other, which is engaged by the snap head from the back to effect locking.

The snap connector is durably secured against ripping out or coming unlocked by itself because the snap head has locking faces on its rear side, which grip the recess in a locking manner from its back. The resistance to ripping out, which is especially notable when the plug is pulled out of a socket, is increased. The securing section of the screw, as an inner core, completely fills out the opening in the finger, in fact in the vicinity of the snap head thereof, so that even strong forces which could possibly cause an inherent radial yielding inward in the vicinity of the snap head, and thus cause unlocking, are absorbed. The snap connector is thus in a position to resist even extremely strong ripping forces.

Still further advantages according to the invention allow for the increase in resistance to being ripped out, for here the tensile forces acting on the outer housing part when the plug is pulled out of a socket are directed via the housing wall onto the head of the screw which is accessible from the outside and are absorbed thereby and at the other end are directed, by the snap ring firmly seated axially on the screw, to the end face of the inner housing part. With this embodiment, accordingly, the snap connector is exposed either not at all or only very slightly to the forces exerted when the plug is pulled out. The forces exerted by the outer housing part on the inner housing part when the plug is inserted are transmitted in any event through pass-fitting and supporting surfaces, so that in that sense, as well, the snap connector is relieved of stress.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
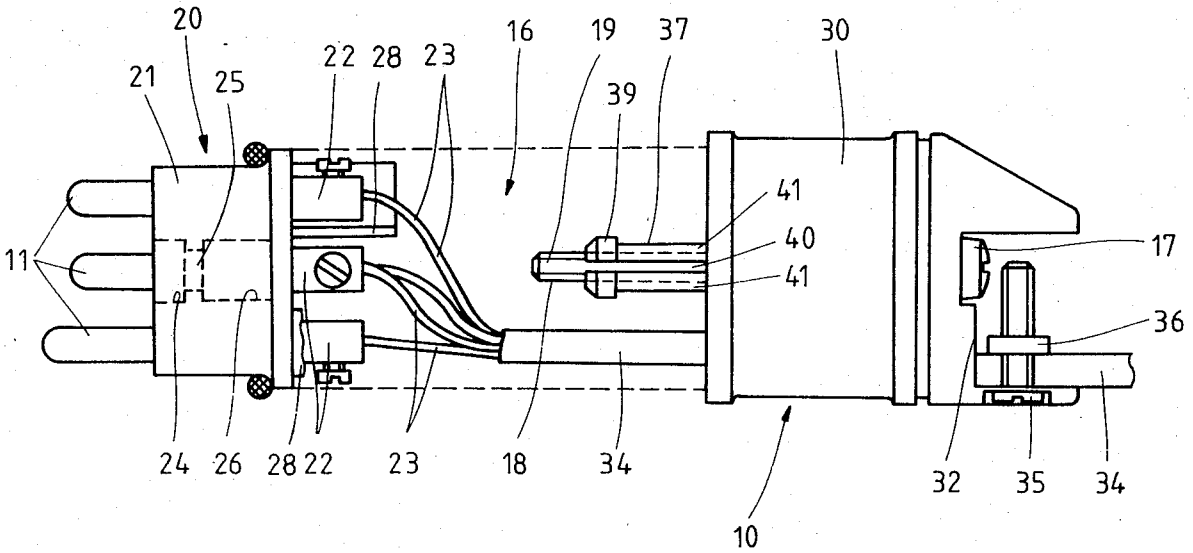
FIG. 1 is a schematic side view of a multi-pole electric plug, the two housing parts of which have been taken apart.
Figure 6:
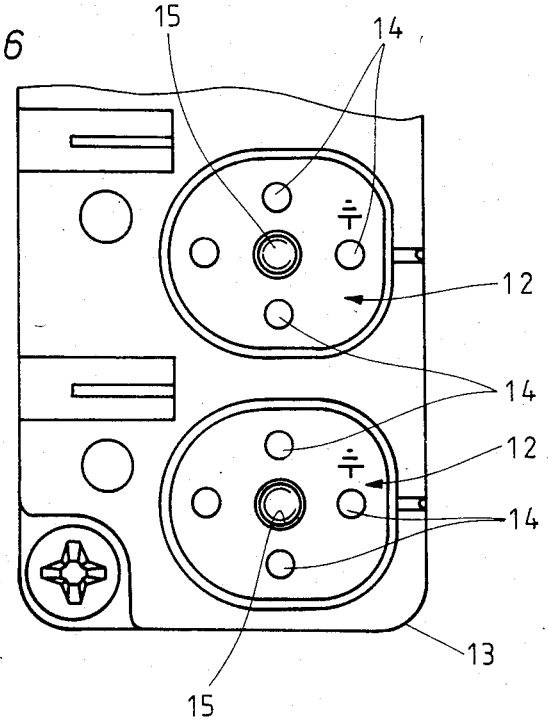
FIG. 6 is a plan view of a portion of a plug distributor having individual sockets associated with the plug.

According to FIG. 1, the multi-pole electric plug 10 has four poles and in terms of the disposition and embodiment of the contact prongs 11 is adapted to engage the sockets 12 of a plug distributor 13 (see FIG. 6). Each socket 12 contains four contact sleeves 14 grouped substantially concentrically around the center. A threaded sleeve 15 is located in the center.

The plug 10 has an inner housing part 20 of plastic, which has an outer shaped section 21 corresponding to the contour of the socket 12, and the four protruding contact prongs 11 as well as the associated electrical connections 22 for connecting the cable 23. The connections 22 are separated from one another by walls 28 molded onto the housing part 20, thus assuring reliable insulation even against current jumping across the air path. Two respective walls 28 form brackets, for instance an upper and a lower bracket as seen in FIG. 1, in which the respective connection 22 is supported.

The inner housing part 20 fits into an outer housing part 30 of plastic, which to this end contains an inner cavity 31 open toward the housing part 20. The cavity 31 is closed, on the side remote from the inner housing part 20 inserted into it, by means of a molded housing wall 32, which contains a pass-through opening 33 for the plug cable 24 (see FIG. 2). A conventional tension relief means is located to the side of the housing wall 32, having two screws 35 and a cross bracket 36.

Both housing parts 20 and 30 are held together in the put-together direction by at least one fastening element, which comprises a snap connector 16 which automatically snaps into place. The snap connector 16 has a finger 37 protruding from the housing part 30 in the put-together direction, which is molded on in one piece to the housing wall 32 and from there leads out through the cavity 31 and out of the housing part 30 and protrudes toward the housing part 20. The finger 37 is molded like a sheath which is hollow on the inside. This inner passageway is marked 38. On its protruding free end, the finger 37 has a molded snap head 39 which is somewhat thicker and comprises an approximately annular head part having a larger diameter. Such snap heads are known per se in plastic snap connections. Over a portion of its length, including the snap head 39, the finger 37 has four longitudinal slits 40 distributed at uniform angles around the circumference, the slits separating spring tongues 41 which are capable of yielding radially inward.

Associated with the finger 37 having the snap head 39 is a recess 24, as the other element of the snap connector 16, on the inner housing part 20; the recess 24 is in the form of a passageway bore and allows the finger 37 to pass through. In the vicinity of a radially inwardly protruding annular shoulder 25, this recess 24 is engaged from the back in an axially locking manner by the snap head 39 (see FIG. 1). The recess 24, in the form of the passageway bore having the annular shoulder 25, is disposed substantially in the center of the contact prongs 11 disposed approximately concentrically therewith. The finger 37 is located concentrically therewith. The recess 24 has a section 26 located in front, viewed in the direction of putting together the plug, of the annular shoulder 25, which section 26 serves as a guide section for the finger 37 with the snap head 39 when the plug is put together.

Figure 2:
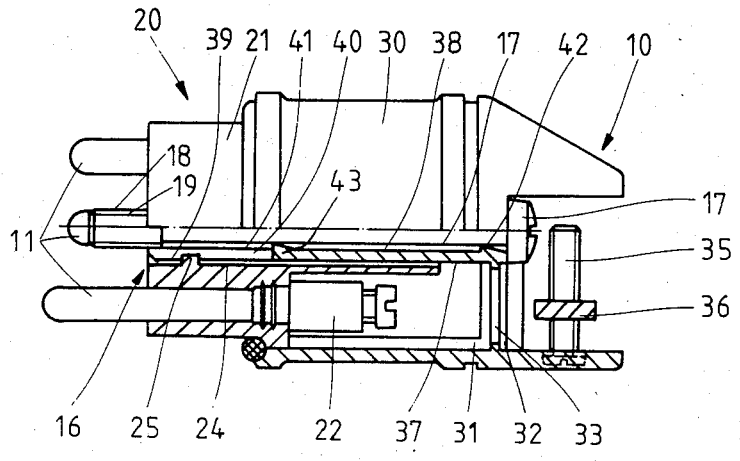
FIG. 2 is a partially cutaway side view of the complete plug.
Figure 3:
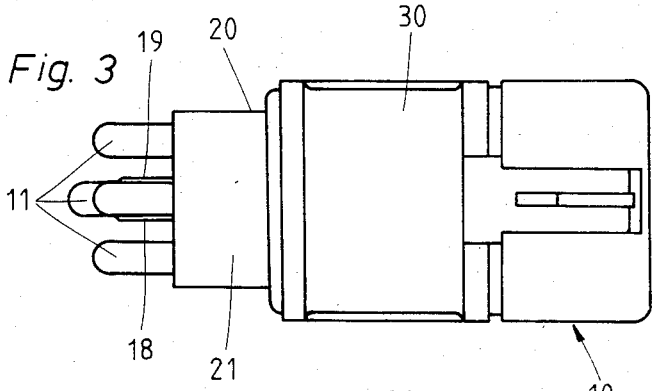
FIG. 3 is a plan view of the plug.
Figure 4:
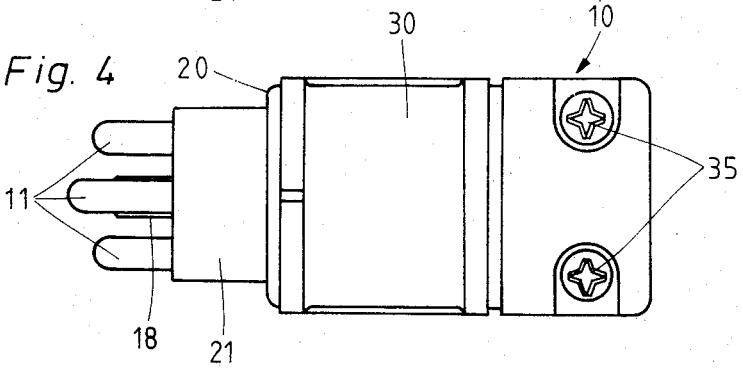
FIG. 4 is a view of the plug from underneath.
Figure 5:
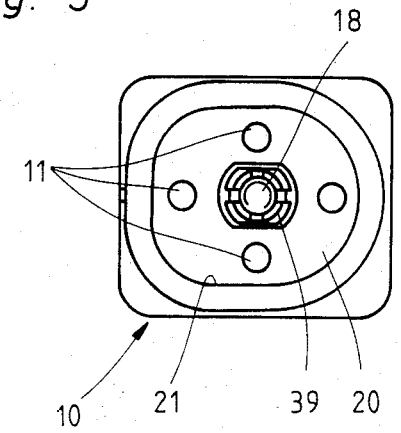
FIG. 5 is a view of the plug looking at the end face.

The passageway 38 of the finger 37 (see FIG. 2) has a screw 17 passing through it, the head of which, accessible from outside, strikes against the outside of the housing wall 32 (see FIG. 1). With a segment 18 toward its end and having a thread 19, the screw 17 protrudes in the same direction as do the contact prongs 11. The screw 17 can additionally be axially secured, when the plug 10 is completely assembled, by means of a snap ring, now shown, on the left end of the inner housing part 20 as seen in FIG. 2. The thread 19 of the segment 18 fits into the threaded sleeve 15 of the sockets 12 (see FIG. 6). The outer diameter of the segment 18 having the thread 19 is kept approximately the same size as the inner diameter of the passage 38 in the finger 37. The segment 18 with the thread 19 is thereby embodied as a specialized securing segment, which whenever the screw 17 is in the set-point position seen in FIGS. 2–4 prevents a spring-elastic radial compression of the individual spring tongues 41 of the finger 37 and thus prevents the snap head 39 from snapping out of its locked position. Only after the snap ring has been loosened and the screw 17 has been displaced so far to the right as seen in FIG. 2 that the segment 18 is located outside the axial vicinity of the spring tongues 41 can the spring tongues 41 yield radially inward, so that the snap head 39 can axially pass through the annular shoulder 25 which is gripped from behind. The complete removal and loss of the screw 17 from the housing part 30 is prevented by means of at least one front securing protrusion 43 projecting toward the interior, which in the axial vicinity of the foot of the spring tongues 41 is located inside the passage 38 and serves as an axial securing stop for the segment 18 of the screw 17 (see FIG. 2). A further, identically embodied securing stop 42 is located spaced apart axially therefrom and near the housing wall 32 for serving the same purpose. It is also possible for the snap ring to be omitted.

The two housing parts 20 and 30 cannot yet be put together, when they are in the finished state shown in FIG. 1. To that end, first the screw 17 in FIG. 1 must be displaced so far to the right that that segment 18 with the thread 19 moves in the described manner beyond the axial vicinity of the spring tongues 41. Then when the plug is put together, the finger 37 with its snap head 39 engages the inside of the guide section 26 of the housing part 20. The front bevel of the snap head 39, which then strikes against the annular shoulder 25, effects together with the annular shoulder 25 a spring-elastic compression of the spring tongues 41 in the vicinity of the snap head 39 such that the snap head 39 is capable of passing through the narrower passage of the annular shoulder 25 and then snapping open again in an inherently spring-elastic manner behind it. Both housing parts 20, 30 are then axially locked in this axial position. The screw 17 can then be displaced forward all the way to the left, into the position shown in FIG. 2. The segment 18 having the thread 19 holds the spring tongues 41 in the locked position in the vicinity of the snap head 29. In this position of the screw 17, radially yielding inward is not possible. The screw 17 is axially secured by the two securing protrusions 42 and 43. If desired, a snap ring can also serve as a further securing means. The plug 10 can now be inserted into a socket 12. Because of an accurately fitting shaped contour of the molded section 21, only a relative rotational position with respect to the socket 12 is possible. The inserted position is secured by tightening the screw 17, which with its thread 19 engages the inside of the threaded sleeve 15. In order to pull out the plug from the socket, first the screw 17 if loosened counterclockwise, which because of the securing means against axial displacement causes the contract prongs 11 to be pressed out of the contact sleeves 14. The process of pulling out the plug is simplified thereby.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A multi-pole electric plug and socket combination, comprising said plug having an inner and an outer housing nested in one another and held together by at least one fastening element, said inner housing comprising contact prongs and oppositely disposed connections protruding therefrom, said outer housing having a cavity open toward and receiving said inner housing, said socket having receptacles for receiving said contact prongs, said fastening element comprising a snap connector means for locking together said inner and outer housing, said snap connector means comprising a finger means protruding in the locking direction from one of said outer housing and inner housing and having a snap head, and on one of said inner housing and said outer housing a recess allowing said finger means to pass therethrough and engaged therein in a locking manner by said snap head, and wherein said finger means has passing therethrough a screw of relatively longer length then said finger means, and on a segment located on one end thereof is a thread for fitting into a central threaded sleeve of said socket for securing said plug and socket together, wherein the outer diameter of said segment is approximately equal to the inner diameter of a passage in said finger means and said segment comprises a securing segment securing said snap head against radially yielding inwardly.

2. A plug as defined by claim 1, wherein said finger means comprises at least two inwardly yielding spring tongues.

3. A plug as defined by claim 2, wherein said finger means comprises a sheath hollow on the inside, which on its free end carries said snap head of an approximately annular head part of larger diameter and on a portion of its length including the head part comprises longitudinal slits disposed at preferably equal angular intervels along the circumference, said slits separating said inwardly yielding spring tongues.

4. A plug as defined by claim 2, wherein said finger means has in said passage, approximately in the axial vicinity of the foot of said spring tongues, a radially inwardly projecting axial securing means for securing against axial movement of said segment of said screw.

5. A plug as defined by claim 1, wherein said finger means and said recess are disposed in the center of said contact prongs disposed approximately concentrically therewith.

6. A plug as defined by claim 1, wherein said recess is formed from a passageway bore having an annular shoulder protruding radially inward, and axially disposed in front of said annular shoulder is a guide section for said finger means and said snap head.

7. A plug as defined by claim 1, wherein said finger means is disposed in said cavity of said outer housing and engages the inside of said recess contained in said inner housing.

8. A plug as defined in claim 7, wherein said finger means is molded and a housing wall closing off said outer housing on the side remote from said inner housing, and said housing wall has radially from said finger means a passageway opening for a plug cable.

* * * * *